US005320350A

United States Patent [19]

Savage

[11] Patent Number: 5,320,350

[45] Date of Patent: Jun. 14, 1994

[54] SLAPBALL HOCKEY GAME IMPROVEMENTS

[76] Inventor: Louis E. Savage, 220 Bayview Ave., Massapequa, N.Y. 11758

[21] Appl. No.: 28,374

[22] Filed: Mar. 9, 1993

Related U.S. Application Data

[63] Continuation-in-part of Ser. No. 823,135, Jan. 21, 1992, Pat. No. 5,222,735.

[51] Int. Cl.[5] ..... A63F 7/06

[52] U.S. Cl. ..... 273/85 A; 273/85 F

[58] Field of Search ..... 273/85 R, 85 A, 85 B, 273/85 E, 85 F, 119 R, 119 A, 126 R, 129 V, 129 W, 129 R, 129 T, 126 A, 127 R, 108; D21/7-11, 16

[56] References Cited

U.S. PATENT DOCUMENTS

| | | | |
|---|---|---|---|
| 1,569,893 | 1/1926 | Steinmetz | 273/119 R X |
| 2,048,944 | 7/1936 | Munro et al. | 273/85 A |
| 2,237,486 | 4/1941 | Henderson | 273/85 A |
| 2,317,126 | 4/1943 | Biderman | 273/85 R |
| 2,382,328 | 8/1945 | Munro | 273/85 A |
| 2,819,082 | 1/1958 | Peters | 273/85 A |
| 3,204,966 | 9/1965 | Saytar | 273/57.2 X |
| 3,466,042 | 9/1969 | Lucci | 273/85 A |
| 3,647,212 | 3/1972 | Barlow et al. | 273/85 B |
| 3,815,911 | 6/1974 | Cooper | 273/85 A |
| 3,907,293 | 9/1975 | Werner | 273/85 A |
| 3,912,269 | 10/1975 | Barlow | 273/85 A X |
| 3,941,381 | 3/1976 | Trbovich | 273/85 R |
| 4,320,902 | 3/1982 | Florkey | 273/85 R X |
| 4,474,375 | 10/1984 | Stockdale | 273/85 B |
| 5,222,735 | 6/1993 | Savage | 273/85 A |

FOREIGN PATENT DOCUMENTS

| | | | |
|---|---|---|---|
| 454453 | 2/1949 | Canada | 273/85 A |
| 632798 | 12/1961 | Canada | 273/85 B |

*Primary Examiner*—Vincent Millin
*Assistant Examiner*—Sebastiano Passaniti
*Attorney, Agent, or Firm*—Schmeister, Morelle & Watts

[57] ABSTRACT

An interactive board game featuring separately actuated game player elements, goalie position and auxiliary player. Improvements to a slapball hockey game are afforded including, among other, a branched bar which is a non-flexible spider element for simultaneously moving a plurality of team players, a recurved rink wall for enlivening game activity, arcuate or sinuous slapper arms meant to emulate hockey player stick and glove apparatus, spring-biased auxiliary slapper units and a redesigned goalie bracket, the use of which more accurately simulates hockey goalie actions.

14 Claims, 3 Drawing Sheets

FIG. 5A
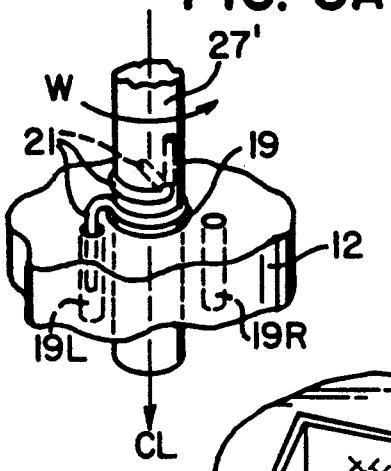
FIG. 5B
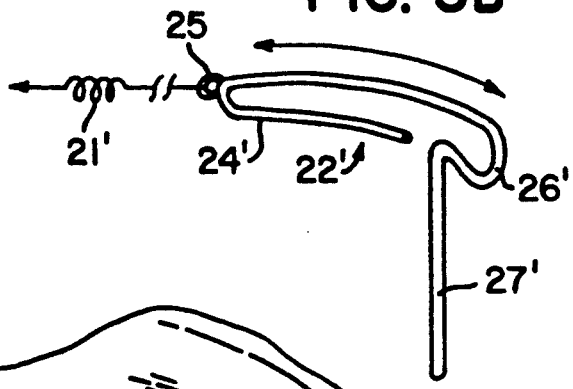
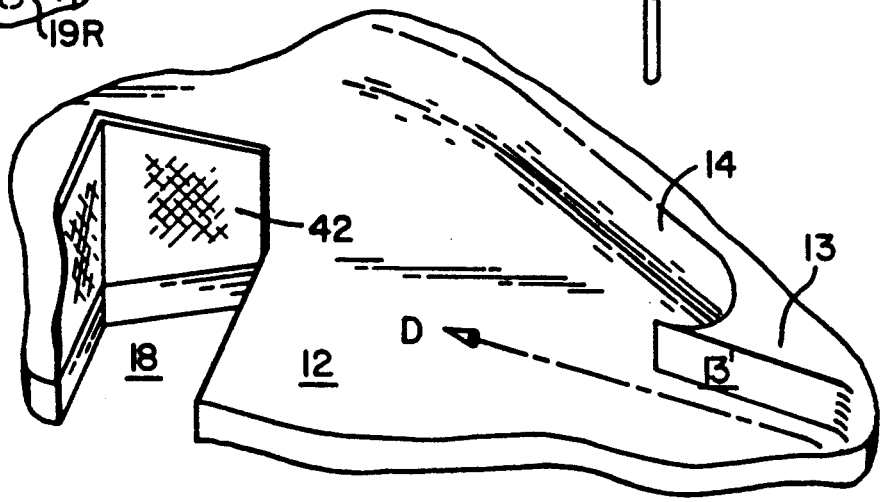
FIG. 6B
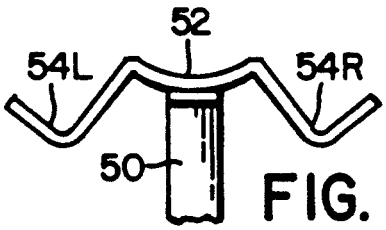
FIG. 7A
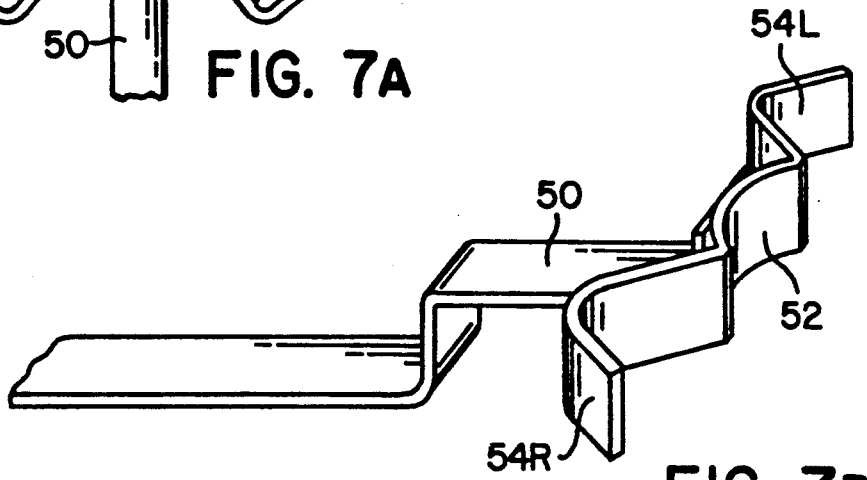
FIG. 7B

SLAPBALL HOCKEY GAME IMPROVEMENTS

This is a continuation-in-part of my U.S. application Ser. No. 823,135 filed on Jan. 21, 1992, entitled SLAPBALL HOCKEY GAME now U.S. Pat. No. 5,222,735.

BACKGROUND OF THE INVENTION

1. Related Disclosures

This application is derived from U.S. patent application No. 823,135, filed on Jan. 21, 1992 and incorporates that work by reference.

2. Field of the Invention

The present invention relates generally to the manufacture of table games and, more particularly, to the physical realization of a table game which simulates the playing conditions of ice hockey. Many incidents of the hereinafter disclosed improvements are emulative in nature and such nuances will be discussed as they are revealed.

3. Discussion of Relevant Art

The reader is referred to my original disclosure of the present invention, U.S. patent application Ser. No. 823,135 wherein I detail the broader aspects of my invention. A relevant piece of art is U.S. Pat. No. 2,048,944 issued to D. H. Munro et al. on Jul. 28, 1936. Therein, Munro et al. disclose a unit player, of their table game, that consists of a wire rod bent so as to emulate a striking arm (or stick) of a player and which is bent so as to form, beneath the table, a lever arm having a hook at the end thereof. The purpose of the hook is to tie a control wire rod thereto, for the purposes of actuating or pivoting the device. In Canada, Patent No. 456,453, issued Feb. 8, 1949, D. H. Munro teaches a table or board game similar to that of '944. Employing a multi-strand wire rod, he actuates the under-table lever arms of the various players causing them to pivot simultaneously on their journaling posts. As in '944, the players, i.e. the discrete pivoting units, are merely wire rods bent to effect a sweeping, striking arm. In both cases, the striking arm is cantilevered straight out from the journaled vertical post or axis of the unit. In both of the disclosures, the fundamental connection between the actuating lever, which is manipulated by the game operator, is wire rod tied to the discrete actuating lever ends which are then, in some cases, spring-biased to the table.

The Canada Patent, No. 632,798, issued to Kobayashi in 1961 discloses a board type hockey game consisting of a rectangular rink which is composed of a floor and surrounding wall with two teams of discrete rod-activated players that move in essentially downfield-upfield directions. Kobayashi employs separately operated goalie positions in which the playing unit consists of a singular bracket having a very shallow U-shape. Each player in this game, has a stick emulating portion of the player piece, including a cut out portion which imitates the natural space occurring between a true hockey player's stick and (skated) feet. Further, the rod actuators for moving the individual players in a general upfield-downfield motion comprise journaled shafts which actuate the player pieces to effect individual slapping or pivoting motions. The main distinction between the individual player unit activation of Kobayashi and that of Munro et al. is that the Kobayashi device requires a plurality of activator rods to control motions of the plurality of player units. This can be somewhat disadvantageous and, because of the myriad slots in the floor of the game, requires the use of a puck shaped playing device rather than a ball. Thus, the Munro et al. game is a much faster paced game. The distinct disadvantage in the Munro game, as well as others, is the plurality of wire or cord segments necessitated for the simultaneous actuation of player units by a single operating handle or lever.

Other relevant disclosures include patents issued to Cooper, U.S. Ser. No. 3,815,911 (1974) and Henderson, U.S. Ser. No. 2,237,486 (1941). Cooper employs triangularly shaped wall extensions which are meant to serve as additional obstacles to the object of play, which is a spinning top. These extensions, therefore, do not deflect a top with any calculated effect, but merely act as would any obstacle in the path of such a device. The patent issued to Henderson, on the other hand, discloses a wall incident that can be generally described as arcuate, changing to planar, the planar portion being orthogonal or perpendicular to a straight wall portion thereof. The arcuate portion of the aforementioned device is provided so that a sweeping arm or paddle may pass through the device's arc unobstructed and cooperatively therewith propel a ball or playing piece through the arcuate portion and away from the proximate goal. Thus, the obstacle or deflection modalities of both the Cooper and Henderson disclosures are precisely what they are seen to be, merely obstacles or devices which cooperate with another fixed part of the game (Henderson) in order to provide some game stratagem which appears to frustrate, rather than aid, scoring by an opposing player.

Before proceeding with a detailed description of the invention, I would like to define certain terms that will be employed throughout the remaining disclosure. The term "player" is used to define the game element that emulates a human hockey player. As to the human enthusiasts who play my slapball hockey game, they shall be referred to as "operators". An "emulator" or "emulation device" is a game device or unit that is designed to emulate a true hockey player or simulate, to some degree, some aspect of real hockey play. The term "board" refers to the playing surface and may be used interchangeably with "rink"; it being understood that, in lieu of "board", "table" may also be used. "Arcuate" shall mean any physical device or parameter that is curvate, curvilinear or sinuous. When I refer to devices or incidents of my game which have shapes in the configuration of a phonetic character, I mean of the general shape of a "W", "U" etc. and will use often therewith an adjective such as "shallow", "deep" etc. Specific motivative devices, such as a coil spring, may be referred to merely as "spring biasing"; the reader is given notice that any reasonable substitute for what is shown in the game, the figures or the claims may be inferred, such as a substitution of an elastomeric band for a coil spring. Finally, the term "defending" goal, etc. refers to a location proximate to where the ball is currently in play to be scored.

SUMMARY OF THE INVENTION

With my latest improvements, I have more closely emulated the game of ice hockey, taking considerable liberties with the use of adjunct mechanisms or designs to give the game operators a much higher degree of challenge and interest in the playing of Slapball Hockey.

One of these improvements consists in the change of a player unit slapping mechanism. I have reshaped the player unit so that two portions now extend oppositely, projecting in cantilever fashion from the vertical post portion of the device, in order to emulate the hockey stick and the player's glove. The former of these is also alternately shaped sinuously, or simply arcuately, so that the portion at the distal end is in the shape of a shallow cup or U in order to releaseably capture or secure the playing ball. Extending in a (generally) opposite direction from the stick portion is the glove emulating portion which has a generally arcuate shape, again in order to releasably capture the ball. Further to the slapper portion, I have added an eyelet, or a tab, to the most distal upper portion of the stick emulator, a modification that will be explained later in this disclosure. In conjunction therewith, the player unit having such an eyelet modification will also have a vertical post, not unlike the original player units of my invention, but lack any underboard extensions from the post.

Another improvement resides in my new design for the goalie mechanism. In order to better imitate the true game player, I have reconfigured the releasable catchment portion of this unit. Where originally I taught a shallow V-shaped catchment, I now improve performance and emulation by the use of a shallow U cup design straddled by a pair of asymmetrical V shaped catchments. The central catchment emulates the stick-knee pad equipment of a goalie while the side V's emulate the gloves of which the true hockey goalie makes considerable use.

Yet, another improvement is a most important modification to the rink wall. Briefly, this is a curving and recurving of the rink wall first outwardly to a slight degree, say an arc of about 30–40 degrees up off the floor of the board, and then a recurve of from about 140° to 150° so as to effect a change in direction of a ball moving up the rink wall to at least 180°. Such an improvement has the distinct advantage over any of the prior art of presenting considerably heightened challenge to a defending operator. A playing object which no longer merely "bounces" off of the rink wall enlivens the game considerably more than would the addition of more versatile player units. An adjunct to the rink wall modification is a change in the shape of the goal cage (screen) from a generally rectangular enclosure to a V-shaped cage with the apex thereof positioned at the center of the former cage base (backstop) area. Now, if a ball were to slide up the rink wall, as modified, and be deflected toward the goalie cage, it would lose none of its impetus, but would be deflected definitely to the left or right of the cage. As with my first version of the game board, I still retain a slightly higher graded area behind the apex of the goalie cage in order to avoid the stalling of a ball in that region.

Another very important improvement is the elimination of cords or rods as activating devices in the form a spider array. The main disadvantage of a spider constructed of cords, rods or wires is that there is invariably some degree of slack in one or more of the connections; thus, actuation of the single controlling lever does not always command immediate, or simultaneous, responsive actuation of the slapper units which are connected to the spider array. I have avoided this problem by providing a singular bracket that I term a "branched bar" comprised of thin, flexible material, such as aluminum or polycarbonate material, and having the shape of a double beamed cross or asymmetrical H, i.e. an H with one lateral shorter than the other. Proximate the tips of the H legs are located a single orifice, of a general elliptical shape. It is my improvement that the modified ends of player unit underboard levers be adapted for either direct connection to the orifices (i.e., drop-in extensions) or linking thereto by connecting an eyelet of the lever to the orifice of a bar portion with a relatively stiff coil spring or nonresilient cord element.

I shall hereinafter describe my improvements in greater detail having reference therein to the following drawings.

BRIEF DESCRIPTION OF THE DRAWINGS

Of the drawings:

FIG. 5A is a spring-biased slapper unit showing the spring detail;

FIG. 5B is an alternate embodiment of a FIG. 4 slapper unit;

FIG. 6B is a perspective of a FIG. 6A diverter in relation to an improved goalie cage;

FIG. 7A is a top plan of the improved goalie catchment mechanism;

FIG. 7B is a perspective view of the FIG. 7A unit;

DETAILED DESCRIPTION OF THE PREFERRED EMBODIMENT

Figure 1:
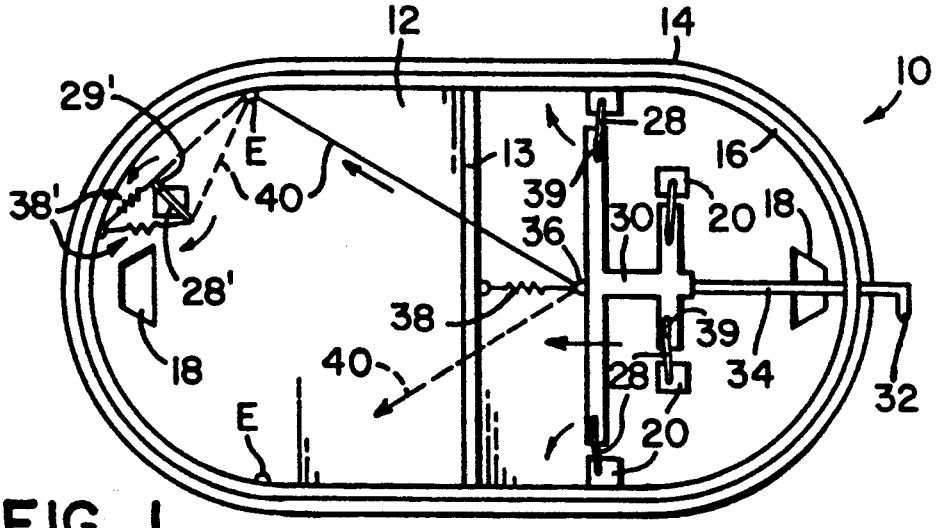
FIG. 1 is a bottom plan schematic of the game board featuring the details of a single (right) playing mechanism.

Referring to the drawings, particularly FIG. 1, there is depicted a bottom plan of my game 10. The game board or game table is comprised of a floor 12 parametrically surrounded by a rink wall 14 and a base 16. Dividing the board between the two goal portions is a center board 13 which is utilized for both support of the floor 12, for general reinforcement and for mounting apparatus thereonto. Proximate each end of the floor 12 are located trapezoidal or triangular (not shown) holes 18 which are used as drop-through wells for the playing object, as well as the passage therethrough of goalie apparatus. Journaling blocks 20 are used to mount the player 22 unit (slappers) and may be inserted into the board 12 (see FIG. 4) or merely fixed to the underside thereof as in my initial disclosure (see Related Disclosures). Shown in FIG. 1 are the actuating lever arms 28 as they project below the journaling blocks 20 and connected to branch bar 30 receptive orifices 39. The branch bar 30 is used to gang two or more of a team's player units for near-simultaneous movement when a game operator manipulates handle 32 which is connected by extension 34 to the branch bar 30 proper. The connection of levers 28 to the branch bar 30 will be taken up later in this disclosure. Continuing with the FIG. 1 disclosure, tying element 36 on the downfield portion of the branched bar 30 is used to connect it to a spring element 38 and thence, to the center board 13. A flexible, non-stretchable wire 40 is passed from tying element 36 of the branch bar 30, through the center board 13 to an eyelet E or similar device which allows it to be drawn to an off-side player (remote) lever by one route, or an alternate, and tied to a lever eyelet 29'. The alternating form of hookup just described allows an off-side player to be rotated clockwise or counterclockwise in its striking action, whichever action is desired by the bracket bar 30 operator. Springs 38' are used to bias the remote lever arm 28' according to the desired return position of the mode selected for operation.

Figure 2:
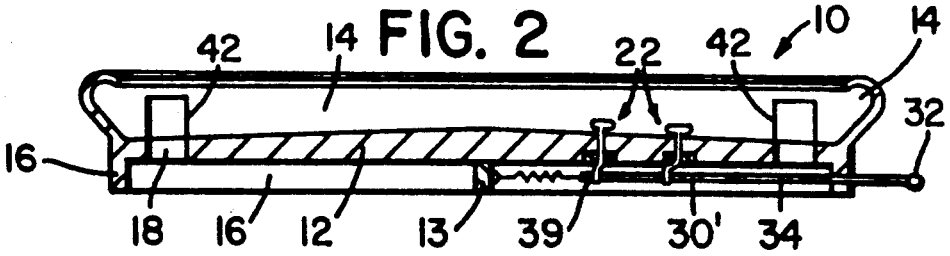
FIG. 2 is a side elevation of the FIG. 1 game board in cross section.

FIG. 2 is a partial elevational view of the FIG. 1 apparatus presented in cross section. This view clearly points out the distinctive features of the rink wall 14 in contrast to my original disclosure and the cited relevant art. As will be discussed hereinafter, the distinctive feature of this arcuate rink wall, one that clearly defines it over the relevant art, is the recurve portion that is used to direct a peripherally traveling ball back onto the board, often times altering the direction but not the momentum of such a playing object. The mechanism at the right hand side discloses the branch bar 30 in partial cross section 30'. Here it may be seen that downward extensions 29 of the lever arms for players 22 engage the branch bar 30 legs at orifices 39. The engagement is a simple drop-in connection which, because of the shape of the orifices 39 as elliptical slots, assures sufficient "slack" as the reciprocating branched bar 30 motivates the levers 28 through essentially arcuate movements as depicted in FIG. 1.

Figure 3:
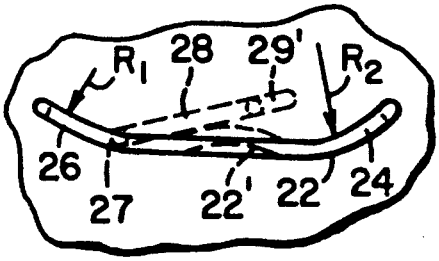
FIG. 3 is a top plan of an arcuate slapper (player) unit.

The top plan of FIG. 3 discloses my new arcuate or curvate slapper 22 design. From the vertical post 27 (phantom), the stick emulating slapper arm 22 extends, cantilevered and parallel to the board 12, arcuate or sinuous 22' manner. A radiused ($R_2$) portion 24 is designed to releasably capture a ball. A glove emulating portion 26 of the slapper extends out from the post 27 opposite the slapper arm 22 and is in fact coextensive in design. The glove emulator 26 is also curvate having a radius ($R_1$) which may or may not be the same as slapper end 24. The actuating lever 28, its depending shaft 29 and alternate hook feature 29' are shown in phantom with much clearer detail presented below.

Figure 4:
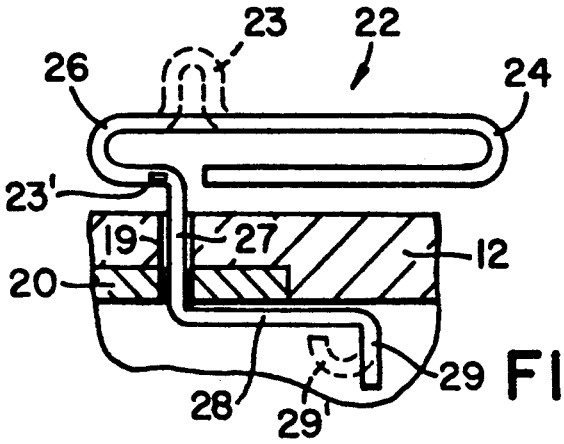
FIG. 4 is a side elevation of the FIG. 3 unit showing alternate connection mechanism on the lower lever arm.

FIG. 4 is a side elevation of the FIG. 3 mechanism showing, in detail, some alternate embodiments for creating a more easily produced apparatus. Inherent in this depiction is the concept of vertical post-lever arms production independent of the slapper arms 22. The vertical post-levers 28 are journaled in journaling block 20 and inserted into recesses of the board 12, or simply fixed adhesively under the board so that the vertical post 27 will communicate with the upper board through holes 19. Additionally, the levers 28 are either bent into an eyelet 29' or essentially at right angles to depend downward, creating branch bar 30 orifice 39 engaging shafts 29. Suitable known means 23' are then used to connect the slapper unit 22 to the vertical post 27 above the board. Additional to the previously described apparatus is the use of vertical extension 23 on the slapper arm 22. This nuance, although providing no additional mechanism for contact with a playing object, is suitable for the placement thereon of indicia useful in the identification of player teams.

Referring jointly to FIGS. 5A and 5B, a slightly different slapper mechanism, with spring-biasing, is shown as a singular slapper 22' having (primed) parts similar to those previously discussed in FIGS. 3 and 4. The distinctive feature of the FIG. 5B article is the straight vertical post 27' having no lever projecting therefrom. Instead, slapper 22' has an eyelet 25 fixed at the end of slapper arm 24'. To this eyelet is connected a cord and spring mechanism 21' which is attachable at several portions on the board such as the goalie cage 42 or the top edge of the rink wall. It is the purpose of this unit to be inserted in the playing board 12 at several locations (to be provided by the manufacture according to the published rules and method of play) so that special "shots" may be taken by one or more of the game operators. An example of such is the central location over the center board 13 for the taking of a "penalty shot" by one of the operators. As an alternative to the spring-biasing mechanism 21', I employ another spring-biasing mechanism 21 as depicted in FIG. 5A. Wherever the holes 19 are located for this embodiment, two holes 19L–19R, of much smaller diameter, are placed straddling the hole 19 which is used for mounting therein vertical post 27'. In FIG. 5A it may be seen that one portion of the small coil spring 21 is affixed on (not shown) or into the post 27', while an opposite end, that has been bent so that is substantially downward and parallel to the vertical post center line (see CL), is set into either hole 19L or 19R. This biasing modality allows the slapper 22' to be set into the hole 19 while orienting its final position toward the direction of desired travel of the "shot" by setting the downward extension of spring 21 into the left or right hole 19L or 19R. Thereafter, the player makes a winding turn W to "cock" the slapper arm 22', places an object of play at the radiused portion $R_2$ (see FIG. 3) and, upon releasing the arm (whether or not afforded eyelet or tab 25) causes the object of play to be propelled in the preplanned direction. As a further means of example, the reader might consider the direction or path of travel D as depicted hereinafter with the discussion of FIG. 6B.

Figure 6A:
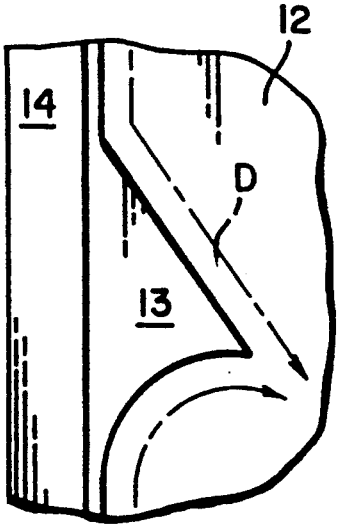
FIG. 6A is a top plan of a diverter unit located along the base of the rink wall.

Referring first to FIG. 6A, I have presented a top plan of a deflector 13 which resides generally at the left side of the field, conterminous with the rink wall 14, so that the arcuate portion depicted therein faces a defending goal. In the original disclosure of my game, I explained how the arcuate portion of deflector 13 would return the object of play toward the goal at whose left side it was positioned. Further, a ramp portion of this deflector will deflect a "shot" in the direction D as indicated (note: towards the proximate, "defending" goal); a distinction over prior art. Reference to FIG. 6B clearly depicts how the "shot" D moves along the planar face 13' of the deflector 13, also toward "defending" goal 18. The reader will note that the rink wall 14 is shown with arcuate detail and the only vertical planar portions are the deflector ramp 13' and the triangular shaped goalie cage 42. I have found the triangular shaped goalie cage, that is, a shallow V form to be an improvement over my original device. Also, as mentioned earlier, taking advantage of this ramp or angular shaped deflection surface 13', allows one much greater versatility in making a "penalty shot" using the apparatus of FIGS. 5A and/or 5B.

Along with the goalie cage 42 modification, I have improved the goalie device considerably. To the goalie bracket 50, I place (at the end thereof), a catchment device comprising a ribbonous strip of generally inflexible material shaped, at the center 52 thereof, in the form a shallow U and, at the left and right ends of the shallow U and concatenated thereto, two asymmetrical, shallow V portions 54L and 54R. These give the overall device the shape of a stylized W effecting a releasable catchment device, the center 52 of which emulates a goalie's stick and skates while the V shaped ends 54L and 54R emulate stick and gloves. FIG. 7B shows the goalie catchment device in perspective.

Figure 8:
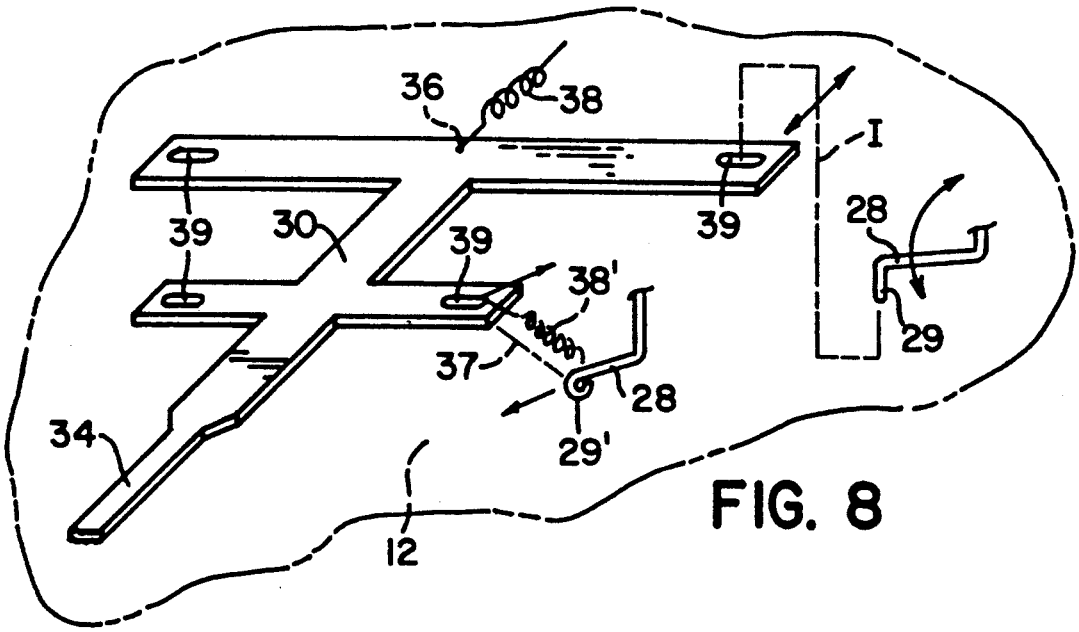
FIG. 8 is a perspective detail of the branched bar with variable slapper engagements.

Referring more particularly now to FIG. 8, the branch bar 30 is shown with its connection to the levers 28 of the various slapper units. As may be seen from this assembly perspective, the connective portions of the branch bar are the elliptical orifices 39 at the ends of the asymmetrical H leg members or bar legs. As may be seen through the underside of the board 12, the branch bar 30 is secured by extension 34 and by the spring-biasing mechanism 36, 38. The various levers 28 are afforded either eyelet 29' or downwardly depending shank 29 ends. The shank 29 is simply dropped into orifice 39 where, upon actuation of the branch bar 30, it finds sufficient latitude for movement to allow the arcuate movement shown without any binding between the shank 29 and the orifice 39. The insertion of shank 29 is indicated (I) while an alternate connection mechanism of eyelet 29' is depicted by the coupling symbol (right angled opposing arrows) signifying either cord 37 or spring 38' apparatus.

Figure 9:
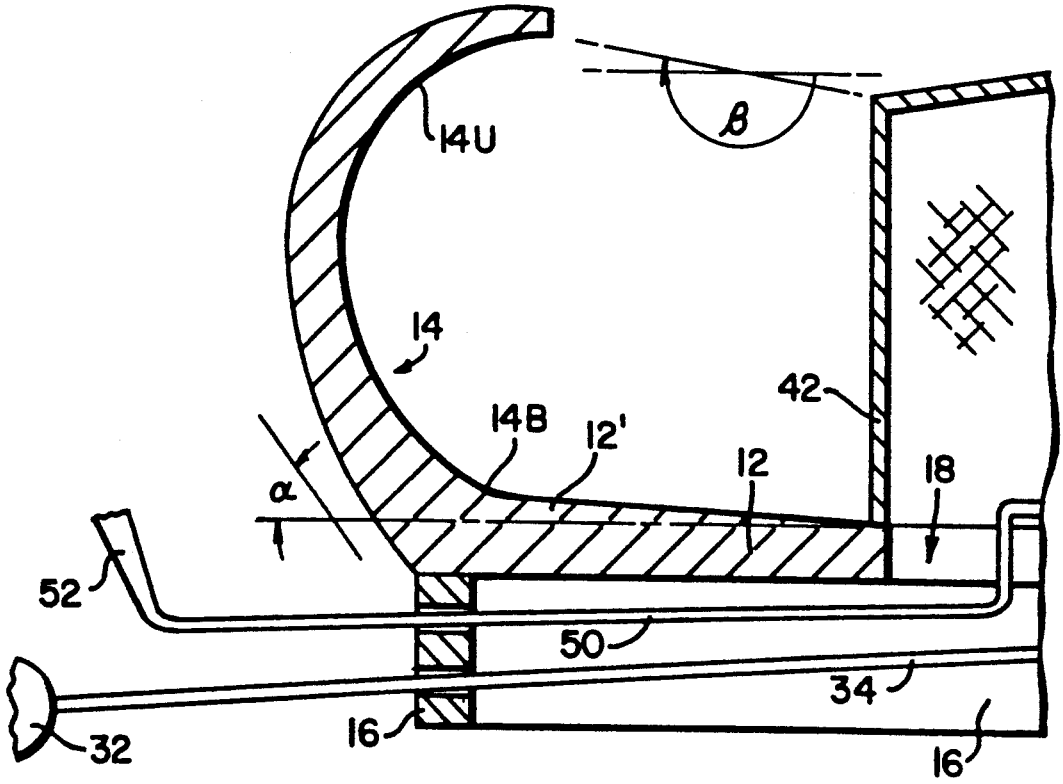
FIG. 9 is a cross-sectional elevation of the game board immediately behind a goalie cage.

Final to the drawings, FIG. 9 provides a detail, in cross sectional elevation, of my rink wall improvement. The plane of the board 12 is depicted with the angular change of 14B as $\alpha$, an angle of about 30°–40°. The wall then rises and recurves at 14U effecting a final recurve totaling at least 180° ($\beta$). The portion behind the goal cage 42 remains slightly elevated 12' to foreclose the possibility of a "stalled" ball or object of play behind the cage 42. Remaining apparatus not shown in the earlier figures is goalie bracket 50 and operator lever or handle 52.

Novel aspects of my original disclosure, such as the spring-biased goalie position, additional to separately operated goalies, capable of moving side to side as well as backward and forward, have not been belabored in this disclosure. What I have done is provided apparatus for a more challenging game that can readily incorporate innovations and modifications by the game operators. Such improvements and modifications are encouraged and will be readily generated by various operators as they become familiar with the use of my invention. It is my desire to allow as great a latitude as possible in the modification of my game consistent with the hereinafter appended claims.

What is claimed is:

1. In a slapball game having two teams, each said team including a plurality of slapper units, each slapper unit formed of a wire bent so as to form a ball engaging arm subtending a link arm through a vertical post means, each slapper unit pivotally mounted on an essentially oval board, said board peripherally enclosed by a wall and having a goal keeper orifice and mechanism proximate each of two arcuate ends thereof, an improvement comprising:

said wall having a concave inner surface of a shape that, in cross section, is essentially a simple hook which at a base thereof arcs about 30°–40° from the board and, proximate a top thereof, arcs additionally to approximate a hook total of at least 180° so that a ball moving against and up said wall is directed back to the board.

2. The game of claim 1 further comprising a slapper linkage improvement characterized by a singular, thin branched bar of asymmetrical H shape for ganged linkage to the link arms of each said slapper unit, so that upon movement of the bar, all slapper units to which said bar is connected will simultaneously pivot.

3. In a slapball game having two teams, each said team including a plurality of slapper units, each slapper unit formed of a wire bent so as to form a ball engaging arm subtending a link arm through a vertical post means, each slapper unit pivotally mounted on an essentially oval board, said board peripherally enclosed by a wall and having a goal keeper orifice and mechanism proximate each of two arcuate ends thereof, an improvement comprising:

said wall having a concave inner surface of a shape that, in cross section, is essentially a simple hook which at a base thereof arcs about 30°–40° relative to a floor portion of the board and, proximate a top thereof, arcs additionally to approximate a hook total of at least 180° so that a ball moving against and up said wall is directed back to the board;

a singular, thin branched bar of asymmetrical H shape for ganged linkage to the link arms of each said slapper unit, so that upon movement of the bar, all slapper units to which said bar is connected will simultaneously pivot; and a goal keeper mechanism that is independent of the branch bar, comprising a handle means connected by an elongate bar to a goalie-emulating bracket for releasably capturing a ball, said bracket comprising a central U shaped portion straddled on each side by, and concatenated to, an asymmetrical, shallow V shaped portion, said U and said side V shaped portions in combination emulative of goalie stick and glove mechanisms.

4. In the game of claim 3, a net for a goal formed over an orifice of the goal in the shape of a shallow V with the apex directed toward the end of the rink served by said goal.

5. In the game of claim 3, a stand-alone slapper unit for manual power shooting comprising vertical post means, a horizontally extending and curving arm projecting from the post means and spring-biasing means for providing transmittal of manual power by a game operator to the arm.

6. The game of claim 5 wherein said spring biasing means includes a two-ended coil spring wound about said post means, an end of said spring fixed to the post means and another end extending and oriented downwardly, parallel to the post means, for fitting into a second hole in said board located proximate a first hole in which the post means is removably inserted.

7. The game of claim 3 wherein each said slapper unit is further characterized by a cantilevered, arcuate slapper arm extending from said vertical post means and a slapper arm extension of arcuate shape projecting beyond said vertical post means in essential co-extensive continuity with the slapper arm and, at an end of the link arm, said branched bar.

8. The game of claim 7 wherein at least one auxiliary slapper unit is characterized by a slapper arm with connection means thereon, an extension arm and an extended non-linkable vertical post means for stand-alone usage and wherein positioned along said wall, between an auxiliary slapper unit position and a goal keeper orifice is a wall-integral deflector mechanism, said deflector mechanism having an arcuate portion facing the goal keeper orifice and a substantially flat angular face which intersects the arcuate portion and faces essentially away from the goal keeper orifice and adapted by disposition and geometry to deflect a playing object propelled by an auxiliary slapper unit toward the goal keeper orifice.

9. In a slapball game having two teams, each said team including a plurality of slapper units, each slapper unit formed of a wire bent so as to form a ball engaging arm subtending a link arm through a vertical post means, each slapper unit pivotally mounted on an essentially oval board, said board peripherally enclosed by a wall and having a goal keeper orifice and mechanism proximate each of two arcuate ends thereof, an improvement comprising:

said wall having a concave inner surface of a shape that, in cross section, is essentially a simple hook which at a base thereof arcs about 30°–40° relative to a floor portion of the board and, proximate a top thereof, arcs additionally to approximate a hook total of at least 180° so that a ball moving against and up said wall is directed back to the board;

a singular, thin branched bar of asymmetrical H shape for ganged linkage to the link arms of each said slapper unit, so that upon movement of the bar, all slapper units to which said bar is connected will simultaneously pivot; and each said slapper unit further characterized by a cantilevered, arcuate slapper arm extending from said vertical post means and a slapper arm extension of arcuate shape projecting beyond said vertical post means in essential co-extensive continuity with the slapper arm and, at an end of the link arm said branched bar.

10. The game of claim 9 wherein at least one auxiliary slapper unit is characterized by a slapper arm with connection means thereon, an extension arm and an extended non-linkable vertical post means for stand-alone usage and wherein positioned along said wall, between an auxiliary slapper unit position and a goal keeper orifice is a wall-integral deflector mechanism, said deflector mechanism having an arcuate portion facing the goal keeper orifice and a substantially flat angular face which intersects the arcuate portion and faces essentially away from the goal keeper orifice and adapted by disposition and geometry to deflect a playing object propelled by an auxiliary slapper unit toward the goal keeper orifice.

11. In the game of claim 9, a net for a goal formed over an orifice of the goal in the shape of a shallow V with the apex directed toward the end of the rink served by said goal.

12. In a slapball game having two teams, each said team including a plurality of slapper units, each slapper unit formed of a wire bent so as to form a ball engaging arm subtending a link arm through a vertical post means, each slapper unit pivotally mounted on an essentially oval board, said board peripherally enclosed by a wall and having a goal keeper orifice and mechanism proximate each of two arcuate ends thereof, an improvement comprising:

said wall having a concave inner surface of a shape that, in cross section, is essentially a recurvature from a base that effects an initial arc from the board of about 30°–40° and, proximate a top thereof, said wall arcs additionally to an approximate recurve total of at least 180° so that a ball moving against and up said wall is directed back to the board; and a singular, thin branched bar of asymmetrical H shape for ganged linkage to the link arms of each said slapper unit, so that upon movement of the bar, all slapper units to which said bar is connected will simultaneously pivot; and a stand-alone slapper unit for manual power shooting comprising vertical post means, a cantilevered, extending and curving arm projecting from the post means and spring biasing means for providing transference of manual power by a game operator to the arm.

13. The game of claim 12 wherein said spring biasing means includes a two-ended coil spring wound about said post means, an end of said spring fixed to the post means and another end extending and oriented downward and parallel to the post means for fitting into a second hole in said board located proximate a first hole in which the post means is inserted.

14. In the game of claim 12, wherein each said slapper unit is further characterized by a cantilevered, arcuate slapper arm extending from a vertical post means and a slapper arm extension of arcuate shape projecting beyond said vertical post means in essential co-extensive continuity with the slapper arm and, at the end of the link arm, said branched bar.

* * * * *